US008563911B2

(12) United States Patent
Cohe et al.

(10) Patent No.: US 8,563,911 B2
(45) Date of Patent: Oct. 22, 2013

(54) DEVICE FOR OPENING AND LOCKING A TAIL UNIT FOR AMMUNITION

(75) Inventors: Patrick Cohe, Neuvy-en-Sullias (FR); Bruno Boissiere, Olivet (FR); Loïc Clech, La Ferte Saint-Aubin (FR)

(73) Assignee: TDA Armements SAS, La Ferte Saint-Aubin (FR)

( * ) Notice: Subject to any disclaimer, the term of this patent is extended or adjusted under 35 U.S.C. 154(b) by 194 days.

(21) Appl. No.: 12/794,753

(22) Filed: Jun. 6, 2010

(65) Prior Publication Data

US 2010/0308153 A1 Dec. 9, 2010

(30) Foreign Application Priority Data

Jun. 5, 2009 (FR) ..... 09 02734

(51) Int. Cl.
*F42B 15/01* (2006.01)

(52) U.S. Cl.
USPC ..... 244/3.27; 244/3.24

(58) Field of Classification Search
USPC ..... 244/3.24, 3.27, 3.28, 3.29, 49
See application file for complete search history.

(56) References Cited

U.S. PATENT DOCUMENTS

| | | | | |
|---|---|---|---|---|
| 3,098,446 | A | 7/1963 | Jasse | |
| 3,986,684 | A * | 10/1976 | Marburger et al. | 244/3.28 |
| 3,986,685 | A * | 10/1976 | Marburger et al. | 244/3.28 |
| 3,998,407 | A * | 12/1976 | Marburger et al. | 244/3.28 |
| 4,336,914 | A * | 6/1982 | Thomson | 244/46 |
| 4,709,878 | A * | 12/1987 | Titley | 244/3.28 |
| 4,714,216 | A * | 12/1987 | Meston et al. | 244/3.29 |
| 5,192,037 | A * | 3/1993 | Moorefield | 244/46 |
| 2008/0099598 | A1 * | 5/2008 | Johnson | 244/3.24 |

FOREIGN PATENT DOCUMENTS

| | | |
|---|---|---|
| EP | 0354088 A1 | 2/1990 |
| FR | 1481664 | 5/1967 |

* cited by examiner

*Primary Examiner* — Timothy D Collins
*Assistant Examiner* — Jamie S Stehle
(74) *Attorney, Agent, or Firm* — Baker & Hostetler LLP

(57) ABSTRACT

A device for opening and locking a tail unit is provided. The tail unit includes a body and at least one fin, pivotable relative to the body along a first axis, that has a projection that forms an element. The device comprises a control ring, slidable relative to the body along a second axis, that includes a component, forming an element, that bears against the projection to deploy the fin, the second axis being non-parallel and non-secant to the first axis. A means for shaping one of the elements during translation along the second axis of the control ring towards the projection of the fin is provided on the other element. The body includes a bearing surface to support the fin during shaping, in which the support of the fin on the bearing surface corresponds to the deployed position of the fin.

10 Claims, 7 Drawing Sheets

DEVICE FOR OPENING AND LOCKING A TAIL UNIT FOR AMMUNITION

CROSS-REFERENCE TO RELATED APPLICATIONS

This application claims priority to foreign Patent Application FR 09 02734, filed on Jun. 5, 2009, the disclosure of which is incorporated herein by reference in its entirety.

FIELD OF THE INVENTION

The invention relates to a device for opening and locking a tail unit capable of fitting any type of ammunition, such as a missile, a rocket or a projectile. The invention relates more particularly to a device for opening and locking an unfolding tail unit of the umbrella type comprising a plurality of fins. The invention also relates to ammunition comprising such a device for opening and locking a tail unit.

BACKGROUND OF THE INVENTION

A tail unit fitted to ammunition generally comprises a plurality of fins uniformly distributed over the periphery to the rear of the ammunition. There are many reasons which may make it necessary, or at least preferable, to provide a tail unit having a span which is greater than the caliber of the ammunition. The presence of a tail unit is notably required when the ratio of the length to the caliber of the ammunition is high, the ammunition thus not being able to stabilize gyroscopically. A tail unit is also required for ammunition which is not stabilized gyroscopically and which is self-propelled in order to increase its range, as, for example, in the case of a rocket. A tail unit may also be used to optimize the accuracy of the trajectory of the ammunition. Such an optimization may notably prove indispensible for guided ammunition.

Generally, a tail unit is designed so as to adopt a folded position at rest, the tail unit fitting the caliber of the ammunition. This folded position makes it possible to reduce the spatial requirement of the ammunition and to facilitate the handling and storage thereof. For ammunition intended to be fired by means of a weapon, for example a launch rocket, the ability of the tail unit to adopt a folded position becomes imperative, the ammunition having to be introduced into a tube of which the diameter is adapted to the caliber of the ammunition. Such a tail unit is known as an unfolding tail unit. When the fins are folded in the longitudinal direction of the ammunition, the unfolding tail unit is said to be of the umbrella type.

The tail unit is open during flight, for example from the exit of the ammunition from the firing tube when the tail unit itself provides the stability of the ammunition or in the final approach phase in the case of guided ammunition. For an unfolding tail unit, the opening essentially consists of a rotation of the fins about their respective axis so that they protrude over the periphery of the ammunition. The rotation of the fins is also known as deployment. The deployment of a fin may be implemented by means of a control ring able to slide relative to the body of the tail unit and able to come to bear against one end of the fin. The control ring may be specific to each fin or common to all of the fins, which may make it possible to ensure the simultaneous opening of the fins. The forward movement of the control ring exerts a force onto the end of the fin and, by a lever arm mechanism, causes the rotation of the fin. The rotation of the fin is, for example, stopped by a bearing surface formed on the body of the tail unit. The control ring may comprise a planar part on which the end of the fin comes to rest at the end of travel of this control ring. The control ring and the fin axes form the principal means of the device for opening the tail unit. A locking device also has to be provided in order to reduce the rebound of the fins on the bearing surfaces to keep the fins in the deployed position and to avoid any return to the folded position.

Due to the relative movement of the different components of the tail unit, it is necessary to provide operating clearances. Said operating clearances have to be even greater if the control ring is common to all the fins. Moreover, other clearances are added to the operating clearances. Amongst these clearances are included clearances as a result of the range of shapes and sizes of the different components forming the tail unit and the clearances caused by the caulking of the bearing surfaces of the body of the tail unit when the fins come into abutment. Said last-mentioned clearances are generally significant, to the extent that the control ring moves forward very rapidly, causing the speed of deployment of the fins to increase. All these clearances are found in the open position, i.e. in the operational position when the fins are deployed. Typically, they introduce an angular clearance of each fin about its axis of greater than five degrees. As a result, said clearances impair the aerodynamic behavior of the ammunition. In particular, they impair the guiding of guided ammunition.

SUMMARY OF THE INVENTION

Embodiments of the present invention advantageously provide a device for opening and locking a tail unit which is of simple design and which makes it possible to limit the clearances between the various components of the tail unit, and, in particular, to eliminate any angular clearance of the fins in the deployed position without requiring any substantial modifications to the design.

In one embodiment, a device for opening and locking a tail unit is provided. The tail unit includes a body and at least one fin, pivotable relative to the body along a first axis, that has a projection that forms an element. The device comprises a control ring, slidable relative to the body along a second axis, that includes a component, forming an element, that bears against the projection to deploy the fin, the second axis being non-parallel and non-secant to the first axis. A means for shaping one of the elements during translation along the second axis of the control ring towards the projection of the fin is provided on the other element. The body includes a bearing surface to support the fin during shaping, in which the support of the fin on the bearing surface corresponds to the deployed position of the fin.

In another embodiment, ammunition comprising a tail unit, and the device for opening and locking the tail unit, is provided.

BRIEF DESCRIPTION OF THE DRAWINGS

The invention will be understood more clearly and further advantages will appear from reading the detailed description of embodiments given by way of example, the description being made with reference to accompanying drawings, in which.

DETAILED DESCRIPTION

Figure 1:
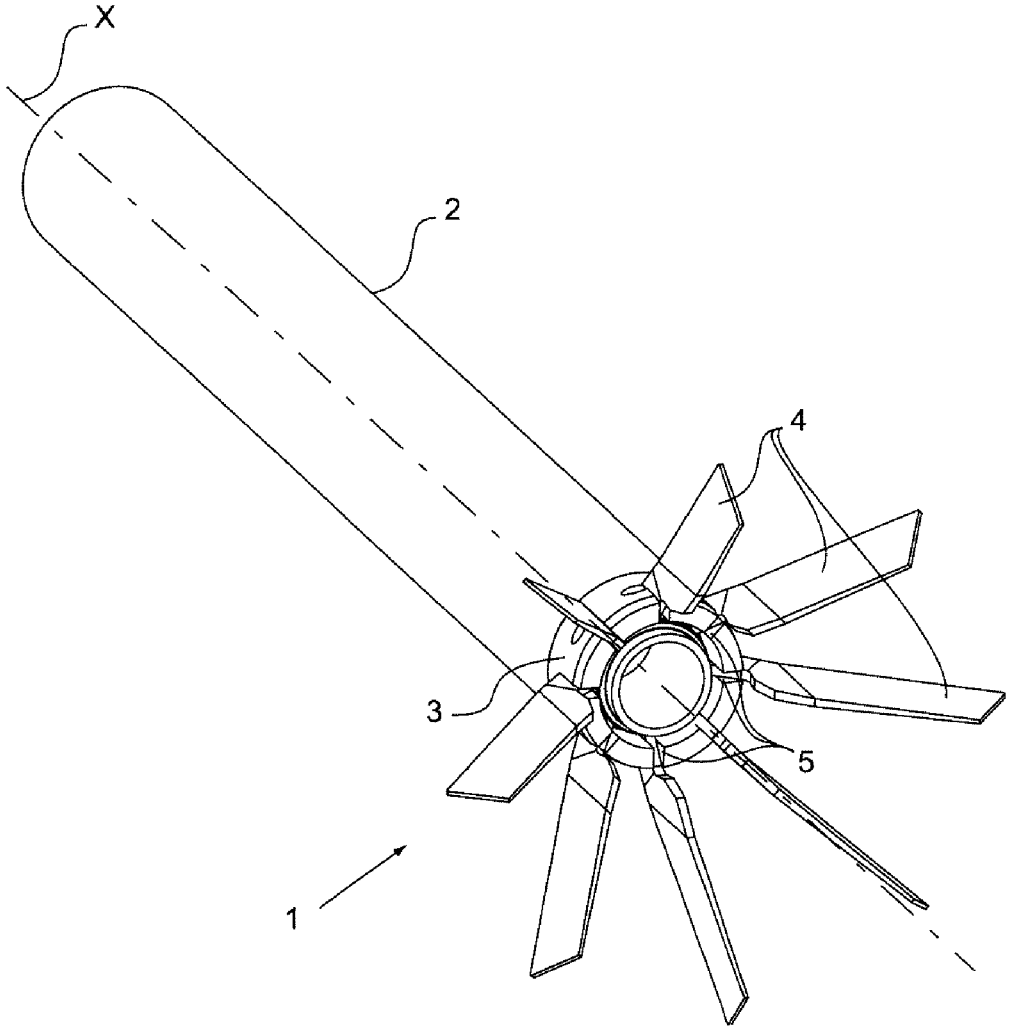
FIG. 1 shows an example of the tail unit fitting an ammunition according to a conventional configuration.

FIG. 1 shows an example of a tail unit 1 fitting an ammunition 2 according to a conventional configuration. According to this configuration, the tail unit 1, shown here in the open position, is arranged to the rear of the ammunition 2 relative to its direction of displacement. The ammunition 2 is shown schematically by a cylinder of revolution along an axis X.

The tail unit 1 comprises a body 3 of diameter substantially equal to the diameter of the ammunition 2 and an assembly of fins 4 distributed uniformly over the periphery of the body 3. In the example of FIG. 1, the tail unit comprises eight fins 4, each fin being separated from its neighbors by an angle of 45°. A tail unit may nevertheless comprise any number of fins without departing from the scope of the invention. Each fin 4 may pivot relative to the body 3 along its own axis. The axes are, for example, distributed in a plane at right angles to the axis X. One end of each fin 4 may be inserted with clearance into a slot 5 of the body 3. The lateral clearance of the fins 4 is thus limited by the sides of the slots 5. The slots 5 are, for example, formed in the vicinity of the axes of the fins.

Figure 2:
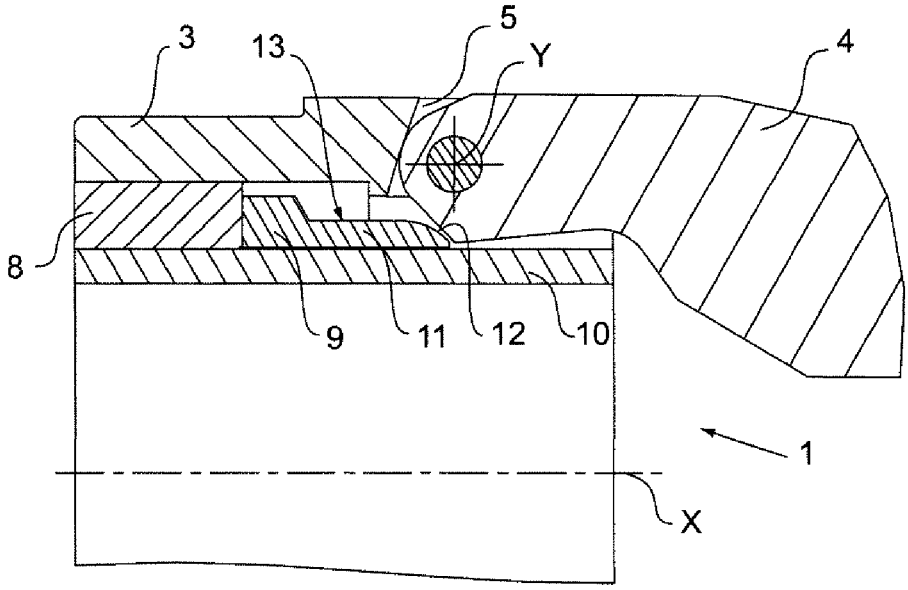
FIG. 2 shows, in a sectional view along the longitudinal plane of a fin of a tail unit, an example of the device for opening and locking the tail unit where the fin is in the folded position.
Figure 3:
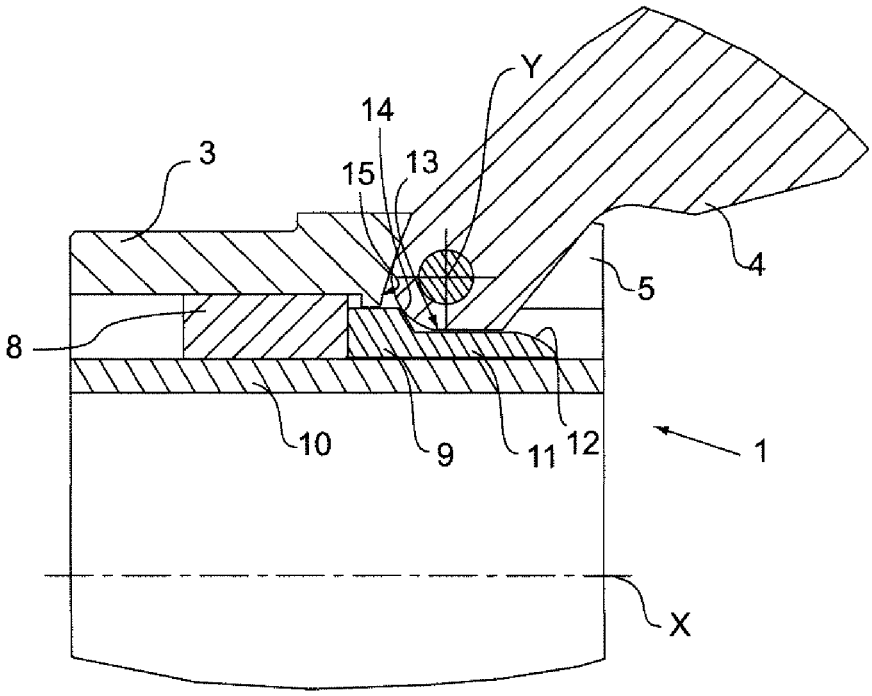
FIG. 3 shows, in a view similar to that of FIG. 2, the device of FIG. 2 where the fin is in the deployed position.

FIG. 2 shows a device for opening and locking a tail unit in a sectional view along the longitudinal plane of one of the fins of the tail unit. The fin 4 shown in FIG. 2 may pivot relative to the body 3 along an axis Y, at right angles to the longitudinal axis X of the ammunition 2. The device comprises a plunger 8 and a control ring 9, each able to slide relative to the body 3 along the axis X, for example by means of a guide 10 for the displacement of the control ring. The plunger 8 may be driven in translation by an increase in pressure of a gas and cause the displacement of the control ring 9. This pressure increase is caused, for example, by a pyrotechnical device, not shown. The control ring 9 comprises a component 11 capable of coming to bear against the fin 4 during its translation. The component 11 is formed so as to permit the rotation of the fin 4 about its axis Y, i.e. the deployment thereof. In particular, the component 11 may comprise a rounded portion 12 which adjoins a cylindrical surface 13 against which the fin 4 comes to bear at the end of travel of the control ring 9, as shown in FIG. 3. The rounded portion 12 may also consist of any other shape permitting the fin 4 to pass progressively from its folded position to its deployed position. In the example of FIG. 2, the axis Y about which the fin 4 pivots is at right angles to the axis X. Naturally, the translation of the control ring 9 may cause the rotation of the fin 4 without orthogonality between the axes X and Y. Generally, the axis Y has to be non-parallel and non-secant to the axis X in order to permit the formation of a lever arm mechanism.

FIG. 3 shows, in a view similar to that of FIG. 2, the device for opening and locking a tail unit in the open position, i.e. when the fin 4 is deployed. The open position is, notably, obtained when the control ring 9 is at the end of its travel, for example when it comes into abutment against the fin 4 by means of a projection 14. In this position, the fin 4 rests on the surface 13. In this manner, the fin 4 is prevented from returning to its folded position. In the opposing direction of rotation, the fin 4 may be held by a bearing surface 15 on the body 3. The fin is thus locked. However, in this exemplary embodiment of the device, the fin 4 is not completely blocked due to the residual clearances between the various connecting parts of the tail unit. Said residual clearances impair the accuracy of the trajectory of the ammunition 2, in particular when the ammunition is guided. The residual clearances include, notably, the operating clearances required for the translation of the control ring 9 and for the rotation of the fin 4. With a view to simplicity of design and in order to provide a simultaneous deployment of the fins, the control ring 9 is generally common to all of the fins. The operating clearances have to be sufficiently high, therefore, to take into account the tolerances of the various components. Moreover, the control ring 9 is generally pushed at very high speed, causing a rapid rotation of the fin 4 which is caulked with the bearing surface 15. An additional clearance is thus introduced during the opening of the tail unit 1. As a result, even with tight operating clearances the residual clearances are often high.

So as to eliminate any residual clearance, in the device for opening and locking a tail unit according to the invention, each fin 4 comprises a projection on which the component 11 of the control ring 9 comes to bear during the opening of the tail unit 1, the projection forming an element and the component 11 forming a further element, and the device comprises means belonging to one of the two elements to shape the other element during the translation of the control ring 9 towards the projection of the fin. In other words, either the component 11 or the projection comprises means to shape the material with which it enters into contact, in this case the projection or the component 11 respectively. By "shaping" is understood any modification to the shape of a component, notably by elastic or plastic deformation, or by machining FIGS. 4 to 7 illustrate, in a view similar to that of FIG. 2, a device for opening and locking a tail unit according to a first embodiment of the invention.

Figure 4:
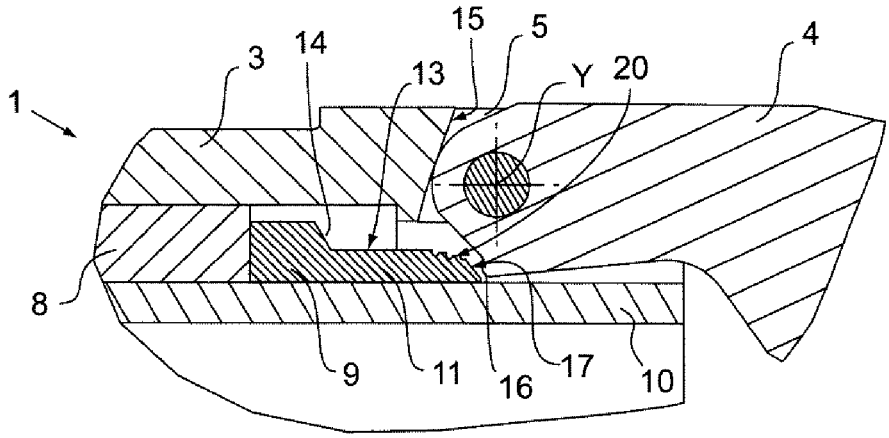
FIG. 4 shows, in a view similar to that of FIG. 2, a device for opening and locking a tail unit according to a first embodiment of the invention where a fin is in the folded position.

In the first instance, reference is made to FIG. 4 where the device is shown when the fin 4 is in the folded position. The device shown in FIG. 4 differs essentially from the device shown in FIGS. 2 and 3 in that the fin comprises a projection 16 protruding in the direction of the control ring 9 when the fin 4 is in the folded position and in that the component 11 has a cutting tool profile between the surface 13 and a leading surface 17, for example a bevel or a rounded portion. This cutting tool profile forms the means for shaping the projection 16. Advantageously, the material of the control ring 9 has a greater mechanical strength than that of the material of the fin 4, for example at a ratio substantially equal to three to one. By way of example, the control ring may be made of steel having a mechanical strength substantially equal to 1200 MPa, and the fin may be made of aluminum having a mechanical strength substantially equal to 400 MPa.

In one particular embodiment, the cutting tool profile comprises a plurality of teeth 20 forming a spindle. Generally, the cutting tool profile may be made according to the usual rules applied to cutting tools, notably as relates to the shape of the teeth 20.

Figure 5:
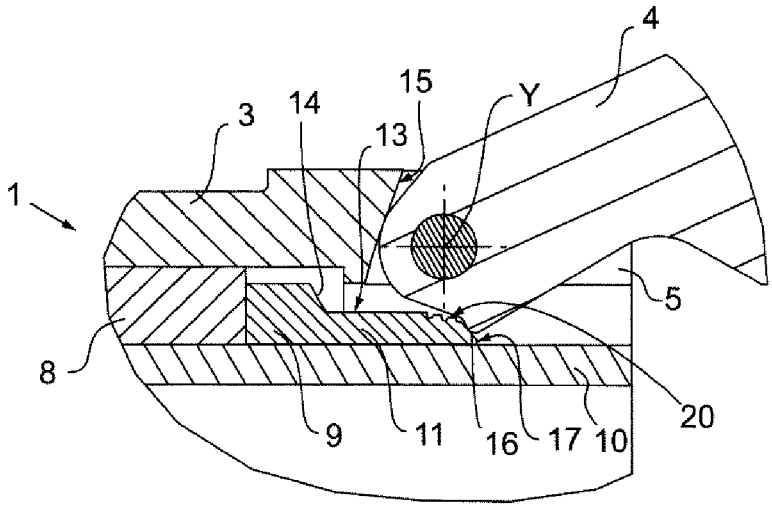
FIG. 5 shows, in a view similar to that of FIG. 2, the device of FIG. 4 where the fin is in the course of deployment.

FIG. 5 illustrates the device shown in FIG. 4 when the fin 4 is in the course of being deployed. According to this figure, the control ring 9 has started its translational movement and the projection 16 bears against the leading surface 17.

Figure 6:
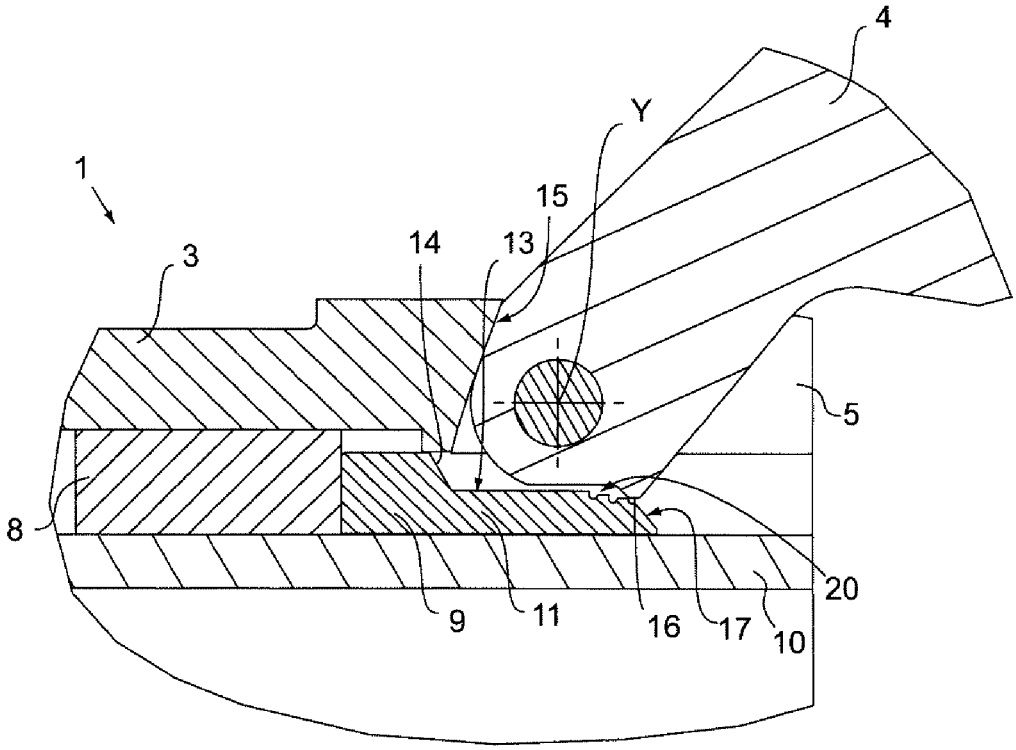
FIG. 6 shows, in a view similar to that of FIG. 2, the device of FIG. 4 where the fin is in the deployed position but not locked.
Figure 7:
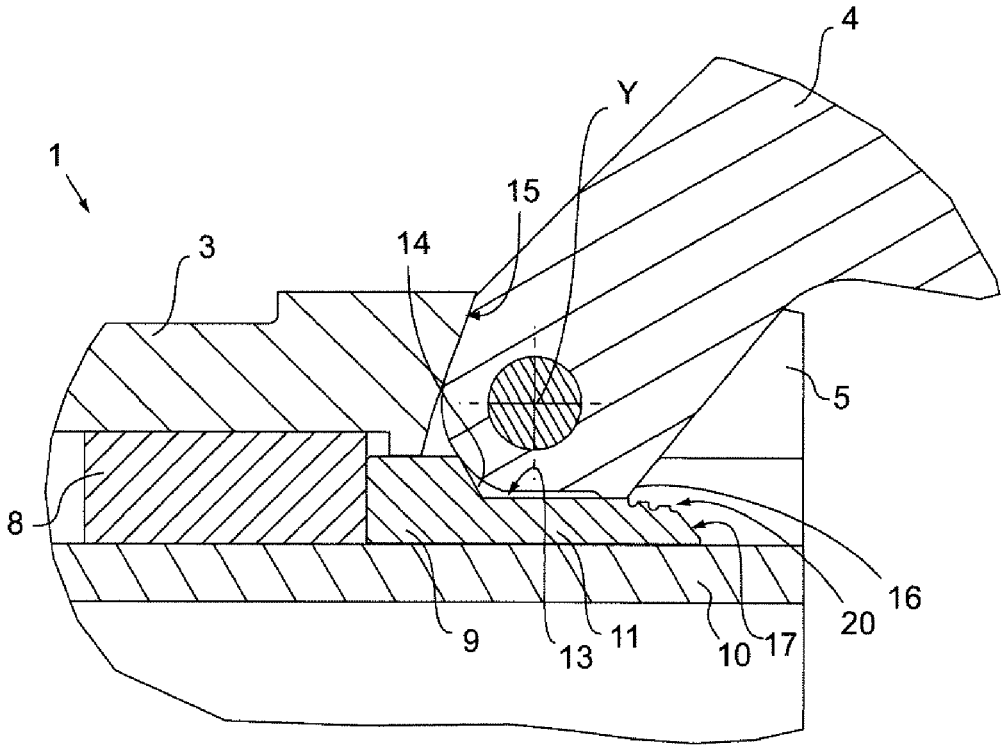
FIG. 7 shows, in a view similar to that of FIG. 2, the device of FIG. 4 where the fin is in the deployed and locked position.

FIG. 6 shows the same device as that shown in FIGS. 4 and 5, when the fin 4 is in the deployed position. Insofar as the projection 16 forms a protuberance, the component 11 exerts a pressure against the projection 16 by means of one of the teeth 20. This pressure produces a force which, by a lever arm mechanism, keeps the fin 4 bearing against the surface 15. This position of the fin corresponds to a position known as the fully open position, the fin 4 being fully deployed. The projection 16 is thus progressively machined by the teeth 20 during the forward movement of the control ring 9, until it bears against the surface 13. The control ring 9 continues its path until the shoulder 14 comes to bear against the fin 4, as shown in FIG. 7. During the entire forward movement of the control ring 9, the fin 4 is held under pressure against the surface 15, this pressure resulting notably from the machining force. Thus, the fin 4 fits tightly, i.e. without clearance, relative to the body 3. In this case, even when the body 3 or the fin 4 is caulked in the region of the surface 15, the fin 4 remains under tension at the end of its deployment, the effect of caulking having been taken into account during the machining of the projection 16. Moreover, the fact that the fin 4 remains under permanent tension makes it possible to provide the non-return function and thus the locking of the tail unit. More specifically, the pressure exerted by the projection 16 on the surface 13 makes it possible to generate frictional forces opposing a possible retraction of the control ring 9.

The device according to the invention is particularly well-suited to a tail unit where the control ring is common to all of the fins. As a result, the projections are machined by the control ring depending on the quantity of material to be locally removed in order to obtain a tight fit between the control ring and each fin. The dimensional constraints for the various components of the tail unit may be relaxed, the clearances due to the range of sizes and shapes of the components being compensated by the machining of the projection.

Figure 8:
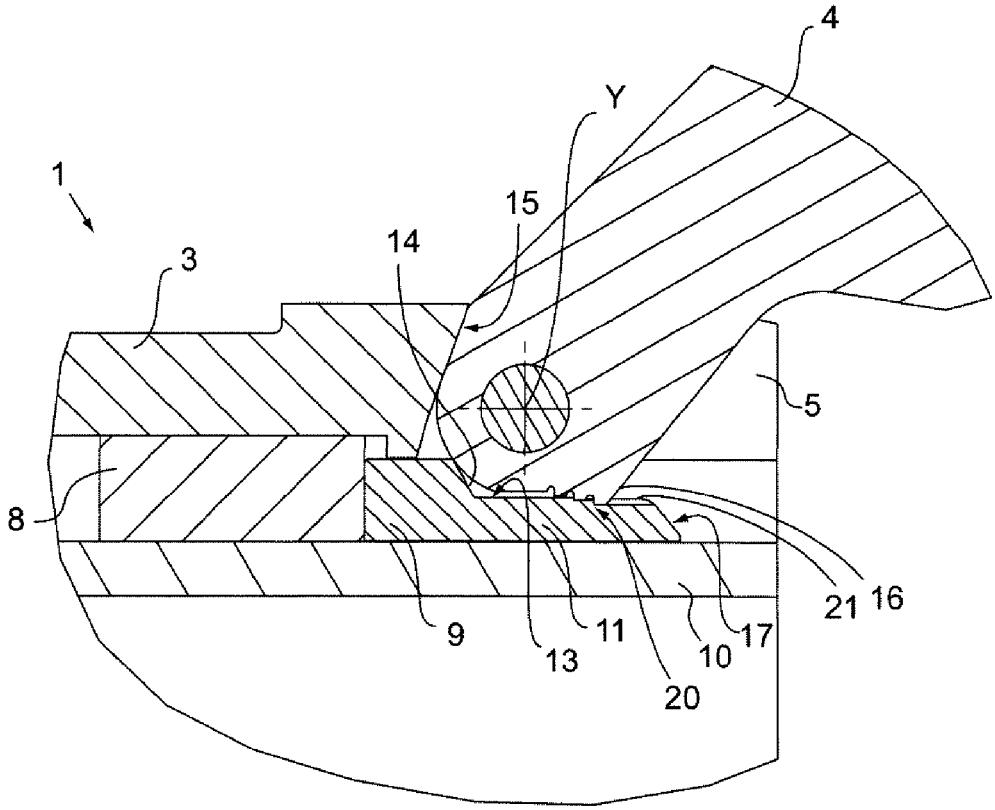
FIG. 8 shows, in a view similar to that of FIG. 2, a device for opening and locking a tail unit according to a second embodiment of the invention where a fin is in the deployed and locked position.

FIG. 8 illustrates, in a view similar to that of FIGS. 2 to 7, a device for opening and locking a tail unit according to a second embodiment of the invention, the fin 4 being fully deployed. According to this embodiment, it is no longer the control ring 9 which is provided with means for shaping the projection 16, but it is the projection 16 which is provided with means for shaping the control ring 9. The material of the fin 4 is thus stronger than the material of the control ring 9, for example substantially three times stronger. In the device shown in FIGS. 8 and 9, the means for shaping the control ring 9 comprise a cutting tool profile. More specifically, the projection 16 is provided with teeth 20 which machine the control ring 9 during the deployment of the fin 4. As in the case of the device according to the first embodiment, the fin 4 comes to bear against the surface 15 of the body 3, and is kept under pressure during the entire advancing phase of the control ring 9, namely until the shoulder 14 comes into abutment against the fin 4. At the end of travel of the control ring 9, the fin 4 remains under tension between the bearing surface 15 and the control ring 9. There is thus no angular clearance between the fin 4 and the body 3. Moreover, when the control ring 9 advances, notches 21 are formed on the surface 13 by the teeth 20. At the end of travel of the control ring 9, the teeth 20 remain fitted in said notches 21 without clearance. In the event that the control ring 9 is made in one piece, the fins 4 are fixed in the region of the projection 16 thereof, which considerably limits the relative displacement between the fins and, as a result, the lateral clearance of each fin relative to the body. As a consequence, relative to the first embodiment, said second embodiment has the advantage of reducing the lateral clearance of the fins.

Figure 9:
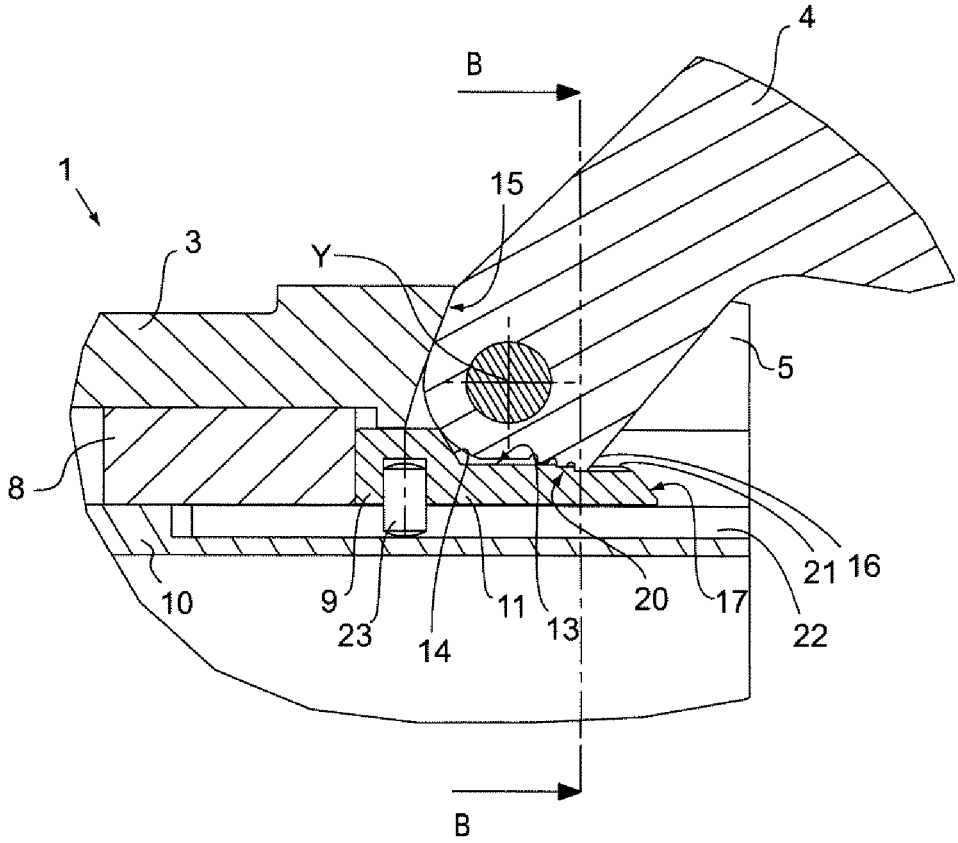
FIG. 9 shows, in a view similar to that of FIG. 2, a particular embodiment of the device shown in FIG. 8.
Figure 10:
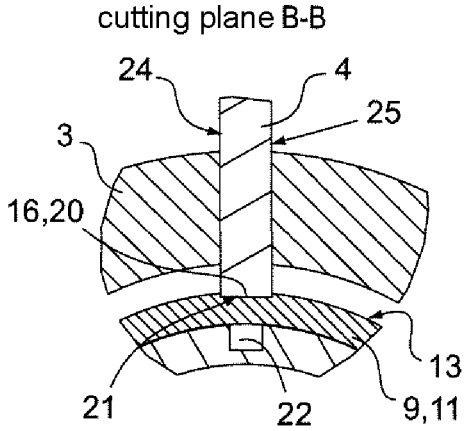
FIG. 10 shows the device shown in FIG. 9 in a sectional view along the cutting plane B-B of FIG. 9.

FIGS. 9 and 10 illustrate a particular embodiment of the device for opening and locking a tail unit according to the second embodiment. FIG. 9 shows the device in a similar view to that of FIGS. 2 to 8 and FIG. 10 shows the device in a sectional view along the sectional plane B-B of FIG. 9, the fin 4 being deployed. The device according to this particular embodiment is distinguished essentially from the device shown in FIG. 8 in that the guide 10 comprises a groove 22 oriented along the axis X and in that the control ring 9 comprises a finger 23 protruding into the groove 22. The presence of the finger 23 in the groove 22 makes it possible to reduce further the lateral clearance of the fins 4 relative to the body 3. More specifically, the finger 23, interacting with the fin 4 by means of the notches 21, forms an additional point of contact with the body 3, this point of contact being relatively remote from the lateral contact surfaces 24 and 25 of the fin 4 with the sides of the slot 5 formed in the body 3. Any other mechanism equivalent to the finger 23 and to the groove 22 may be provided in the region of the kinematic link between the control ring 9 and the body 3 so as to reduce the lateral clearance of the fins 4 relative to the body 3 once the fins 4 are deployed. In particular, the finger 23 and the groove 22 may be substituted by a dovetailed connection.

In the various embodiments of the device for opening and locking a tail unit, it has been considered that the travel of the control ring 9 was stopped when the projection 14 came to bear against the fin 4. However, the travel of the ring may be stopped by any equivalent stop mechanism. Said stop mechanism may, for example, consist of a shoulder formed on the guide 10 and against which the control ring 9 may come to bear.

Moreover, in the various examples shown of the device for opening and locking, the shaping of the control ring 9 by the projection 16 or of the projection 16 by the control ring 9 has always been considered as machining, i.e. local removal of material by a cutting tool. However, the shaping in the sense of the invention has to be understood broadly. It may correspond to a local deformation of material due to pressure generated during the relative displacement of the components of the tail unit 1. The deformation may be plastic or elastic. It may relate to the projection 16 of the fin 4 or the component 11 of the control ring 9. The local removal of material forming, for example, the notches 21 is translated in this case by a substantially equivalent deformation of the projection 16 or of the component 11. Naturally, the device may also be designed so as to provide a deformation both of the projection 16 and of the component 11. More generally, any component located between the bearing surface 15 and the guide 10 may be designed so as to be deformed during the deployment of the fins 4.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A device for opening and locking a tail unit for ammunition, the tail unit including a body and at least one fin pivotable relative to the body along a first axis and having a projection forming a first element, the device comprising:

a control ring slidable relative to the body along a second axis, wherein the control ring includes a component forming a second element to bear against the projection to deploy the fin, wherein the second axis is non-parallel and non-secant to the first axis, wherein one of the first and second elements is configured to machine the other of the first or second elements through a local removal of material during translation of the control ring along the second axis towards the projection of the fin, and wherein the body includes a bearing surface to support the fin during machining, the support of the fin on the bearing surface corresponding to the deployed position of the fin.

2. The device of claim 1, wherein one of the first or second elements has a cutting tool profile machining the other of the first or second elements, the material of the first element having a greater mechanical strength than the material of the second element.

3. The device of claim 2, wherein the material of the first element has a mechanical strength which is substantially three times greater than the material of the second element.

4. The device of claim 2, wherein the cutting tool profile comprises a plurality of teeth forming a spindle.

5. The device of claim 1, wherein the first axis is substantially at right angles to the second axis.

6. The device of claim 1, wherein the body further comprises a guide for the translation of the control ring to reduce the lateral clearance of the fin relative to the body.

7. The device of claim 6, wherein the guide includes a groove oriented along the second axis, and the control ring further comprises a finger protruding into the groove.

8. The device of claim 1, wherein the control ring further comprises a projection bearing against the fin at the end of the machining.

9. The device of claim 1, further comprising a plurality of fins distributed substantially uniformly about the second axis, the body further comprising a bearing surface to support each fin during the machining, the bearing of each fin on its respective bearing surface corresponding to the deployed position of the fin, the control ring coming to bear against each of the projections of the fins.

10. Ammunition comprising:

a tail unit having a body and at least one fin pivotable relative to the body along a first axis, wherein the fin includes a projection forming a first element; and a device for opening and locking the tail unit, the device having a control ring slidable relative to the body along a second axis, wherein the control ring includes a component forming a second element to bear against the projection to deploy the fin, wherein the second axis is non-parallel and non-secant to the first axis, wherein one of the first or second elements is configured to machine the other of the first or second elements through a local removal of material during translation of the control ring along the second axis towards the projection of the fin, and wherein the body includes a bearing surface to support the fin during machining, the support of the fin on the bearing surface corresponding to the deployed position of the fin.

* * * * *